US008522480B2

(12) United States Patent
Shearer

(10) Patent No.: US 8,522,480 B2
(45) Date of Patent: Sep. 3, 2013

(54) SPRING ACTUATED TRANSOM WINDOW

(75) Inventor: Robert R. Shearer, Bradenton, FL (US)

(73) Assignee: Taylor Made Group, LLC, Gloversville, NY (US)

( * ) Notice: Subject to any disclaimer, the term of this patent is extended or adjusted under 35 U.S.C. 154(b) by 0 days.

(21) Appl. No.: 13/248,033

(22) Filed: Sep. 29, 2011

(65) Prior Publication Data

US 2012/0073207 A1 Mar. 29, 2012

Related U.S. Application Data

(60) Provisional application No. 61/387,780, filed on Sep. 29, 2010.

(51) Int. Cl.
*E05F 1/00* (2006.01)

(52) U.S. Cl.
USPC ..... 49/387; 16/356; 16/291; 16/293

(58) Field of Classification Search
USPC ..... 49/386, 387; 16/355, 356, 291, 16/293
See application file for complete search history.

(56) References Cited

U.S. PATENT DOCUMENTS

| | | | | |
|---|---|---|---|---|
| 2,322,933 | A * | 6/1943 | Harmon et al. | 16/278 |
| 4,313,280 | A * | 2/1982 | Ehret et al. | 49/141 |
| 4,543,686 | A * | 10/1985 | Rock et al. | 16/288 |
| 4,690,468 | A * | 9/1987 | Lau | 312/291 |
| 5,008,977 | A * | 4/1991 | Lautenschlager et al. | 16/278 |
| 7,287,802 | B2 | 10/2007 | Dankert et al. | |
| 2006/0130403 | A1 | 6/2006 | Krehbiel et al. | |

FOREIGN PATENT DOCUMENTS

| | | |
|---|---|---|
| CA | 2 258 314 | 7/1999 |
| DE | 77 10 136 | 10/1977 |
| DE | 30 44 451 | 5/1982 |
| DE | 93 07 504 | 8/1993 |

* cited by examiner

*Primary Examiner* — Jerry Redman
(74) *Attorney, Agent, or Firm* — Nixon & Vanderhye P.C.

(57) ABSTRACT

A multi-piece hinge pivotably connects a top member and a bottom member. The hinge includes an upper hinge member securable to the top member, a lower hinge member securable to the bottom member and fixable in a frame, a hinge cover secured between the upper hinge member and the lower hinge member, and a spring element acting between the upper hinge member and the lower hinge member. The upper hinge member is pivotable relative to the lower hinge member across a pivot range between a closed position and an open position. The pivot range is limited by a stop assembly. In the closed position, the spring element is positioned to bias the upper hinge member toward the closed position, and in the open position, the spring member is displaced over center to bias the upper hinge member toward the open position.

19 Claims, 9 Drawing Sheets

SPRING ACTUATED TRANSOM WINDOW

CROSS-REFERENCES TO RELATED APPLICATIONS

This application claims the benefit of U.S. Provisional Patent Application Ser. No. 61/387,780, filed Sep. 29, 2010, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

The invention relates to a transom window and, more particularly, to an opening transom panel and hinge included in a window assembly with an exemplary application in the transportation industry, such as a motor coach or bus vehicle. The window can be an egress or non-egress style window. Additionally, the window can be a flush style window where the frame is hidden when viewed from outside of the vehicle, or the window could be a style where the frame, or a portion of the frame, is exposed when viewed from outside the vehicle.

This type of window is common to the transportation industry in the bus/motor coach applications as well as the railroad car application. Opening transom type windows are also found in residential and commercial building applications.

It would be desirable to provide an efficient, compact, and easily manufactured and serviceable hinge for the transom window panels.

BRIEF SUMMARY OF THE INVENTION

The described embodiments relate to an opening transom window including an upper vent glass that is pivotable between a closed position and an open position and a lower fixed glass with a hinge therebetween. The hinge is constructed for efficient operation, compactness, ease of manufacture, and serviceability. The hinge includes stop surfaces that define a pivot range for the upper vent glass and a biasing member that functions to bias the upper vent glass toward the closed position when the upper vent glass is in its closed position and toward the open position when the upper vent glass is in its open position. Moreover, the hinge assembly is compact in design, and it is easy to assemble the upper and lower hinges. After inserting the spring member, the hinge cover is positioned for attachment. For servicing, the hinge cover is easily removed, providing access to the internal components.

In an exemplary embodiment, a hinge for a transom window includes an upper hinge member securable to a vent glass of the transom window, and a lower hinge member securable to a fixed glass of the transom window. A hinge cover is secured between the upper hinge member and the lower hinge member, a spring element acts between the upper hinge member and the lower hinge member. The upper hinge member includes a first pivot member cooperable with a corresponding second pivot member of the lower hinge member, and each of the upper hinge member and the lower hinge member includes a stop surface that limits a pivot range of the upper hinge member relative to the lower hinge member. The upper hinge member further includes a first spring seat on a side of the upper hinge member opposite from the pivot member, and one of the hinge cover and the lower hinge member includes a second spring seat. The spring element is secured between the first spring seat and the second spring seat. The upper hinge member is pivotable relative to the lower hinge member between a closed position and an open position, and in the closed position, the spring element is positioned to bias the upper hinge member toward the closed position, and in the open position, the spring member is displaced over center to bias the upper hinge member toward the open position.

Preferably, the first pivot member comprises a rail, and wherein the second pivot member comprises a follower. The hinge cover may include a stop arm extending from a position adjacent the lower hinge member toward the upper hinge member, where a distal end of the stop arm is disposed in a pivot path of the upper hinge member. Each of the upper hinge member and the lower hinge member may include at least one adhesive cavity. The lower hinge member may include a cover seat shaped substantially corresponding to an outside perimeter of the hinge cover, where the hinge cover is positioned in the cover seat.

The lower hinge member may include a hinge cover channel, where a portion of the hinge cover is engaged with the hinge cover channel. In this context, the hinge may be provided with a connector securing the portion of the hinge cover engaged with the hinge channel in the hinge channel. In one arrangement, the hinge cover extends over at least a portion of an outermost surface of the lower hinge member In another exemplary embodiment, a transom window includes a transom window frame, a vent glass pivotable between a closed position and an open position, a fixed glass secured to the transom window frame, and the hinge of the described embodiments disposed between the vent glass and the fixed glass.

In yet another exemplary embodiment, a multi-piece hinge pivotably connects a top member and a bottom member. The hinge includes an upper hinge member securable to the top member, a lower hinge member securable to the bottom member and fixable in a frame, a hinge cover secured between the upper hinge member and the lower hinge member, and a spring element acting between the upper hinge member and the lower hinge member. The upper hinge member is pivotable relative to the lower hinge member across a pivot range between a closed position and an open position. The pivot range is limited by a stop assembly. In the closed position, the spring element is positioned to bias the upper hinge member toward the closed position, and in the open position, the spring member is displaced over center to bias the upper hinge member toward the open position.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
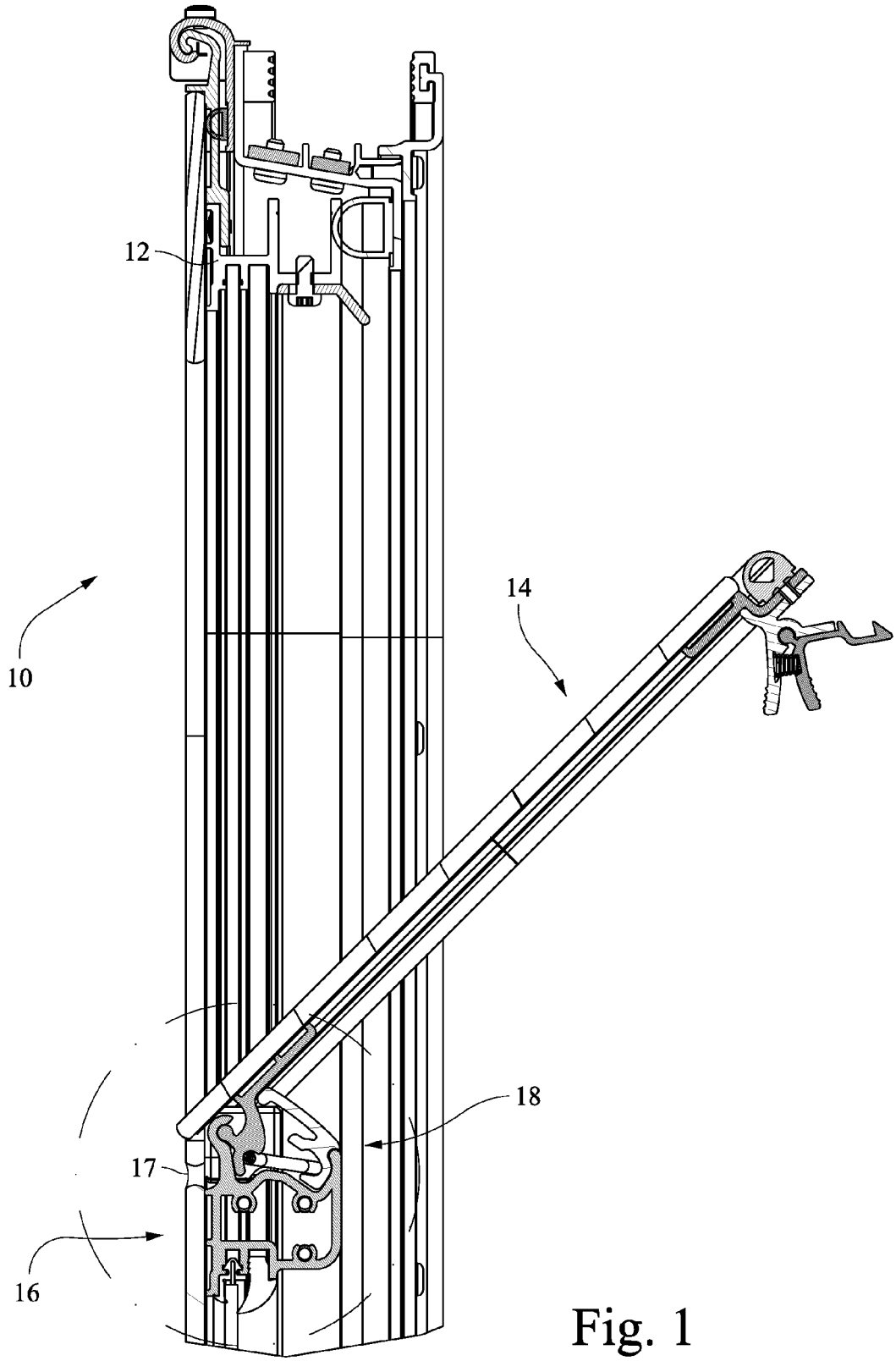
FIG. 1 is a sectional view of the transom window and hinge with the upper vent glass in its open position.

FIG. 1 is a cross sectional view of a top portion of a transom window 10. The window 10 includes a transom window frame 12, an upper vent glass 14 securable to the transom window frame 12 in a closed position, and a lower fixed glass 16 secured to the transom window frame 12. Reference to "glass" throughout the specification is exemplary and is intended to encompass any and all suitable materials, whether translucent or not. A seal 17 is disposed between the vent glass 14 and the fixed glass 16. The vent glass 14 is pivotable between a closed position and an open position (open position shown in FIG. 1) via a hinge 18. As shown, the hinge 18 is disposed between the vent glass 14 and the fixed glass 16.

Details of the hinge 18 will be described with reference to FIGS. 2 and 3. The hinge 18 includes an upper hinge member 20 secured to the vent glass 14 and a lower hinge member 22 secured to the fixed glass 16. The lower hinge member 22 is secured to the frame 12 via suitable connectors 23. A hinge cover 24 is secured between the upper hinge member 20 and a lower hinge member 22. A spring element 26 acts between the upper hinge member 20 and the lower hinge member 22, in some embodiments, via the hinge cover 24.

The upper hinge member 20 includes a first pivot member 28 that is cooperable with a corresponding second pivot member 30 of the lower hinge member 22. As shown, the first pivot member 28 preferably comprises a rail, such as a cylindrical rail, and the second pivot member 30 preferably comprises a follower. Each of the upper hinge member 20 and the lower hinge member 22 includes a stop surface 32 that limits a pivot range of the upper hinge member 20 relative to the lower hinge member 22. In FIG. 2, the stop surface 32 of the upper hinge member 20 extends beneath the first pivot member 28 and engages a neck portion of the lower hinge member 22 beneath the corresponding second pivot member 30 of the lower hinge member 22.

The upper hinge member 20 also includes a first spring seat 34 on a side of the upper hinge member 20 opposite from the pivot member 28. The hinge cover 24 includes a second spring seat 36, an opposite side of which (outside perimeter) is engaged with a cover seat 37 of the lower hinge member 22. The cover seat 37 is shaped substantially corresponding to the outside perimeter of the hinge cover 24 adjacent the second spring seat 36. As shown in FIGS. 2 and 3, the hinge cover 24 is positioned in the cover seat 37. The spring element 26 is secured between the first spring seat 34 and the second spring seat 36. In the closed position (shown in FIG. 3), the spring element 26 is positioned to bias the upper hinge member 20 toward the closed position. In the open position, the spring member 26 is displaced over center to bias the upper hinge member 20 toward the open position.

The hinge cover 24 also includes a stop arm 38 extending from a position adjacent the lower hinge member 22 toward the upper hinge member 20. The distal end of the stop arm 38 is disposed in a pivot path of the upper hinge member 20. As shown in FIG. 2, in the open position, the upper hinge member 20 engages the distal end of the stop arm 38.

Each of the upper hinge member 20 and the lower hinge member 22 may include at least one adhesive cavity 40 for receiving an adhesive. In preferred embodiments, the hinge members 20, 22 are secured to the respective glass members via an adhesive. Alternatively or additionally, the hinge members 20, 22 may be provided with channels for receiving the glass members.

The upper and lower hinge members 20, 22 are preferably formed of aluminum or plastic, but other materials such as steel, stainless steel, or other formable material, may be suitable. The hinge members 20, 22 are preferably extruded, although other forming processes may be used.

Figure 2:
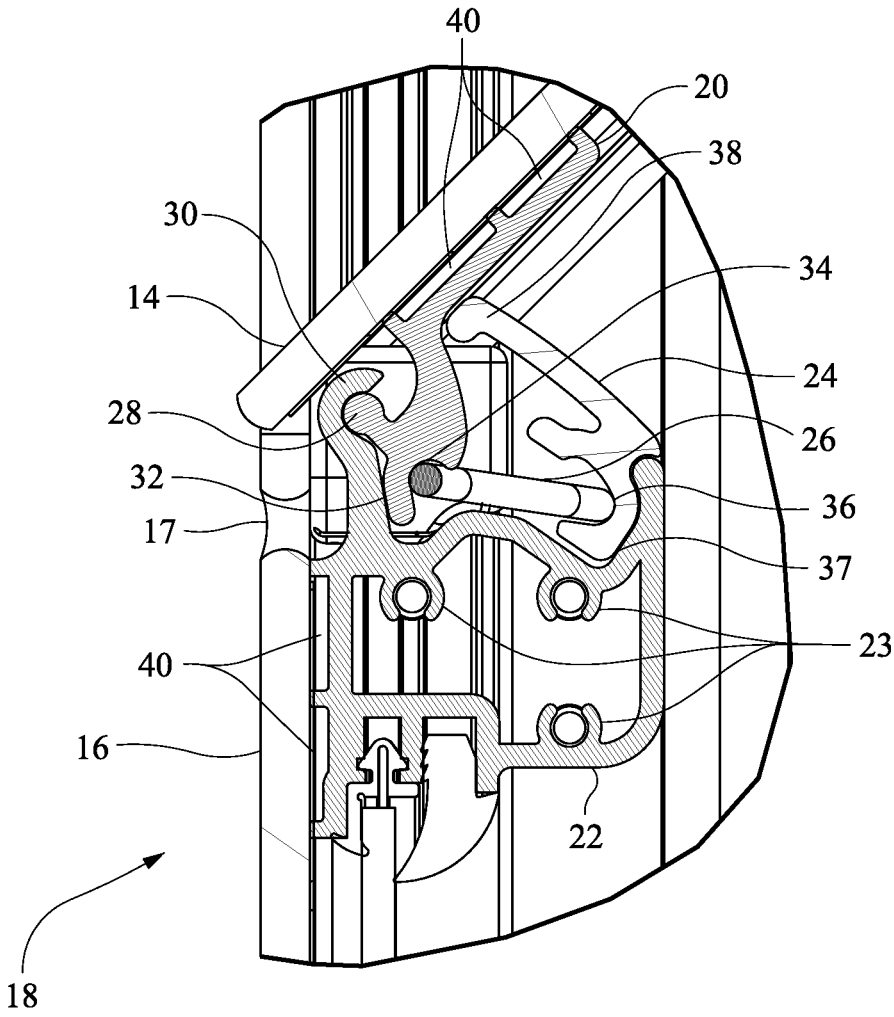
FIG. 2 is a close-up view of the hinge in the open position.
Figure 3:
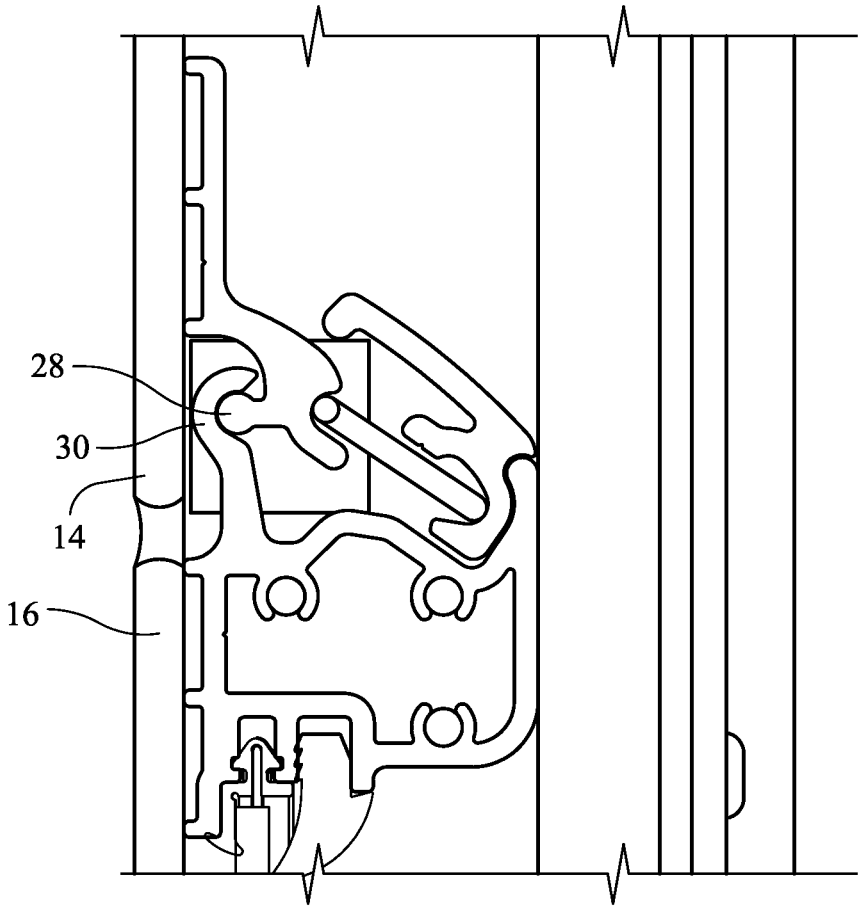
FIG. 3 shows the hinge in its closed position.
Figure 4A:
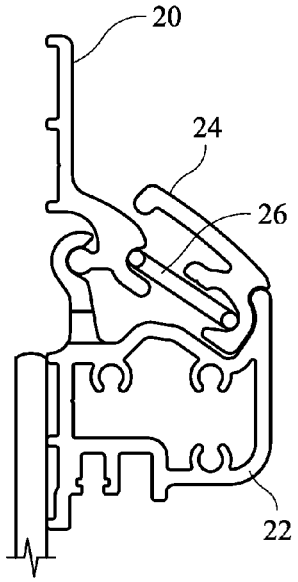
FIGS. 4A-V show alternative variations of the hinge.
Figure 4B:
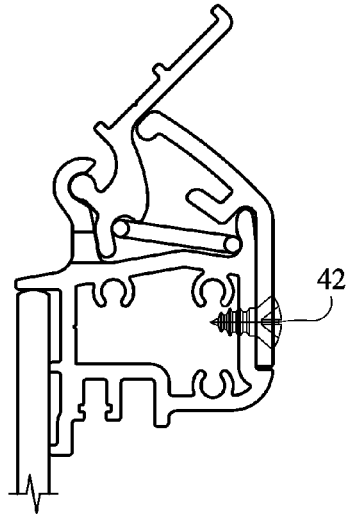
Figure 4C:
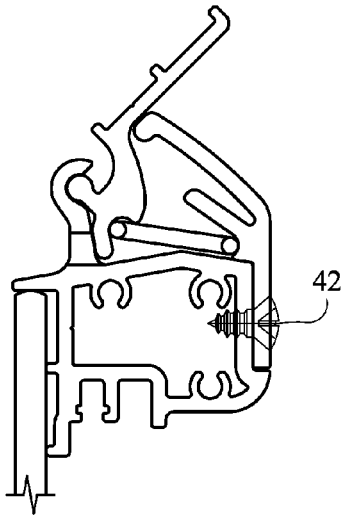
Figure 4D:
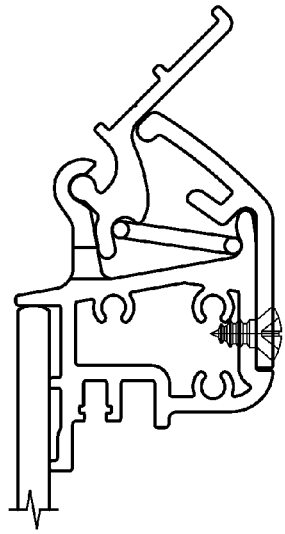
Figure 4E:
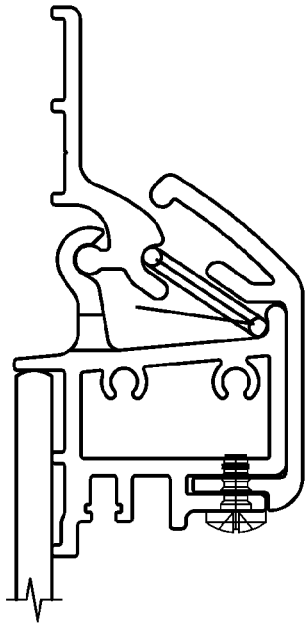
Figure 4F:
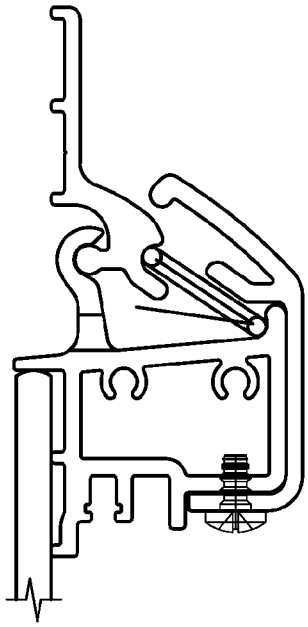
Figure 4G:
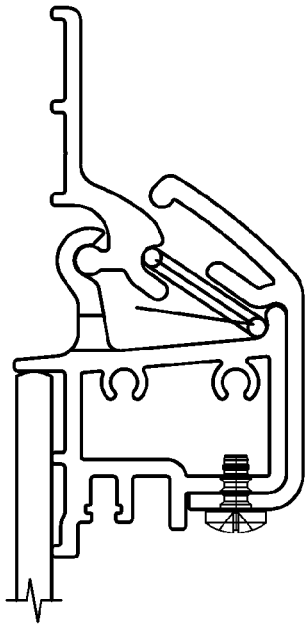
Figure 4H:
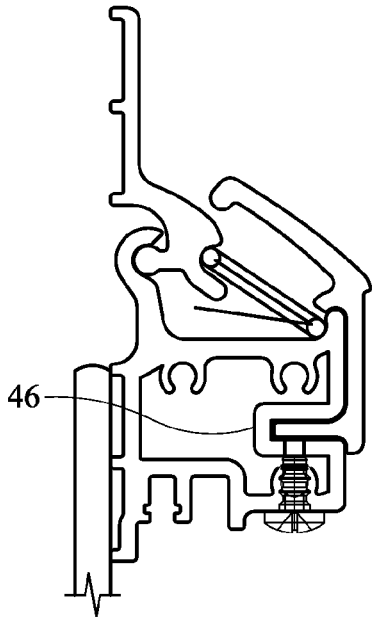
Figure 4I:
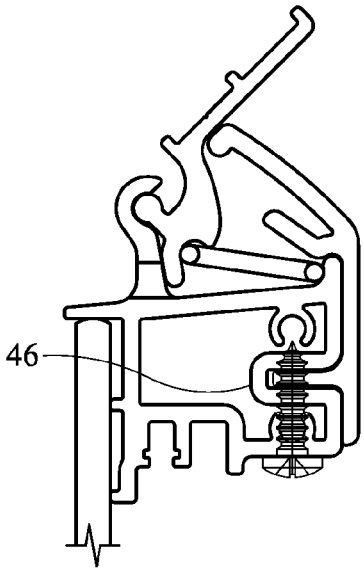
Figure 4J:
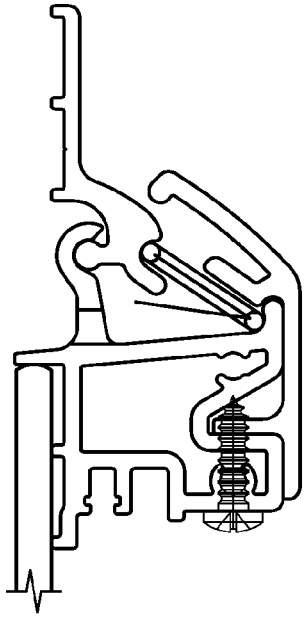
Figure 4K:
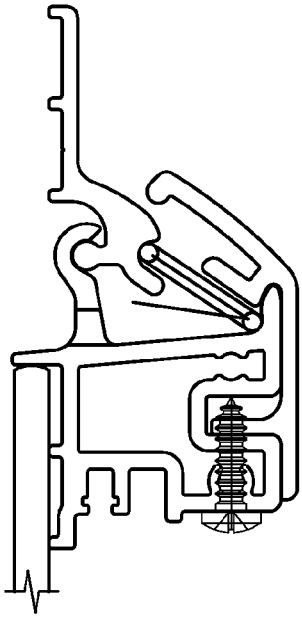
Figure 4L:
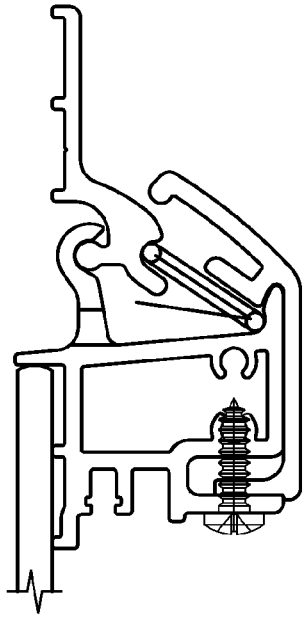
Figure 4M:
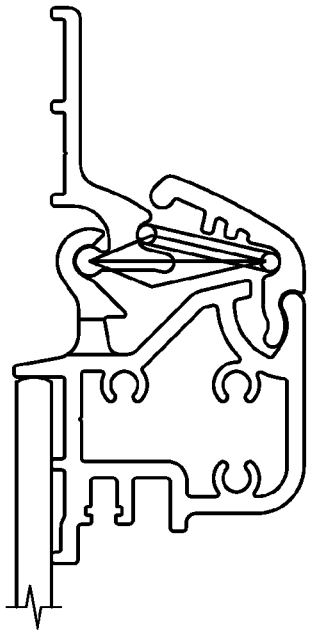
Figure 4N:
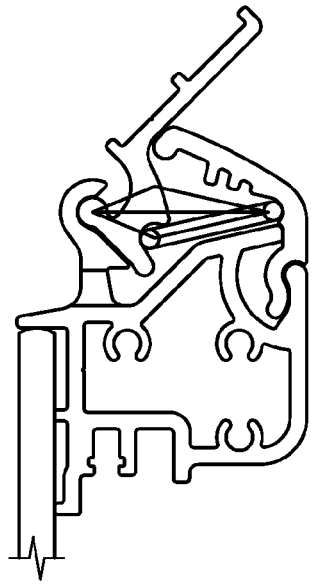
Figure 4O:
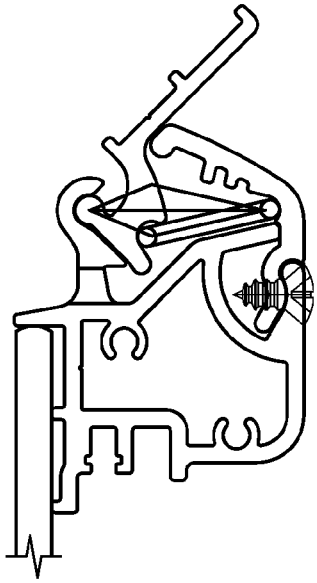
Figure 4P:
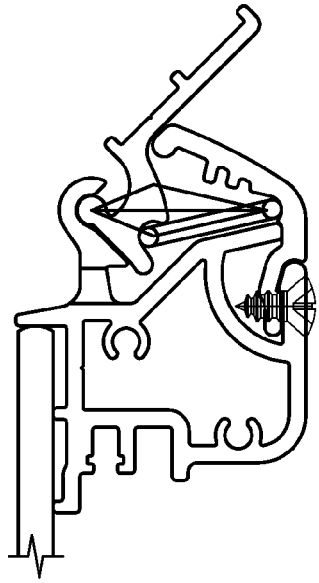
Figure 4Q:
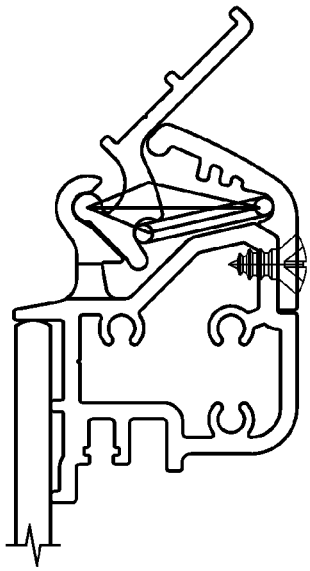
Figure 4R:
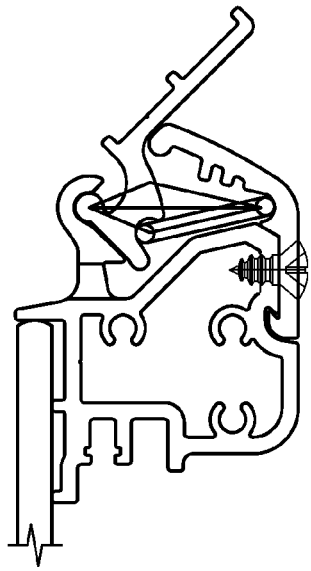
Figure 4S:
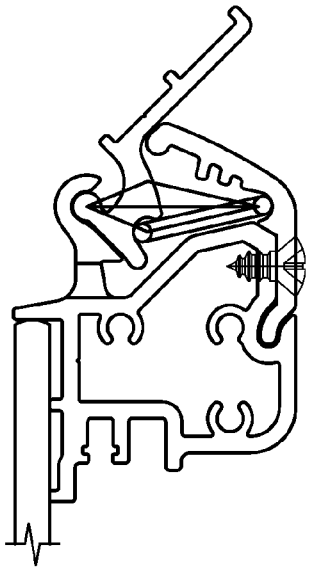
Figure 4T:
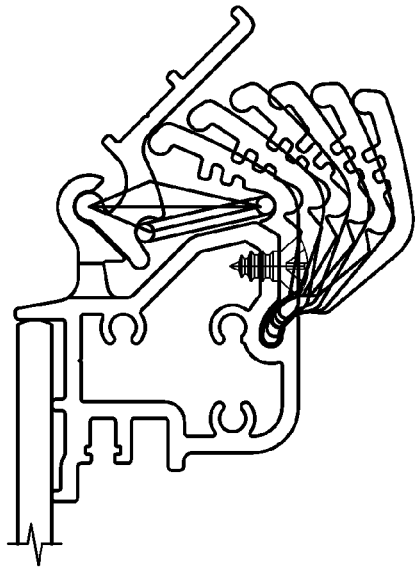
Figure 4U:
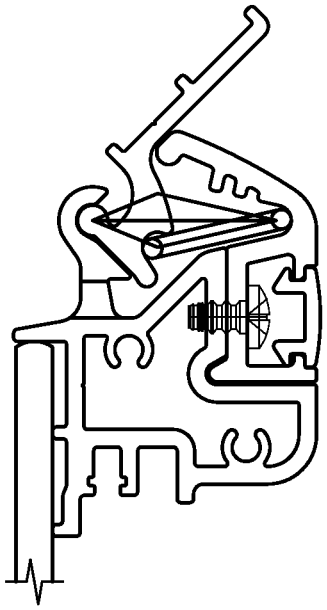
Figure 4V:
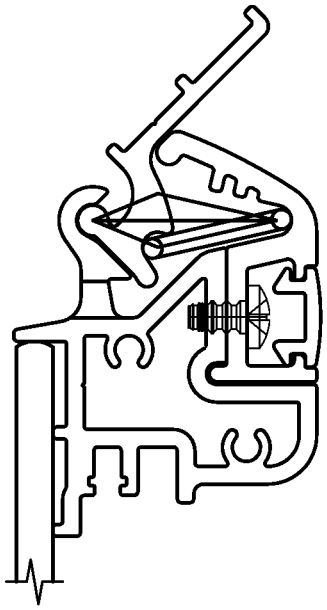

FIGS. 4B-V show alternative variations of the hinge 18 (FIG. 4A corresponds to the embodiment shown in FIGS. 1-3 and is included for ease of comparison). Each variation includes the upper hinge member 20, the lower hinge member 22, the hinge cover 24, and the spring member 26. As shown in FIGS. 4B-L, the hinge cover 24 may extend over the lower hinge member 22 to various degrees. The hinge cover 24 is shown being actively secured to the lower hinge member 22 via a fastener 42 such as a screw or the like. In some variations, the lower hinge member 22 is provided with a channel or pocket 46 in which a portion of the hinge cover 24 is received (see FIGS. 4H-V). The design is serviceable in the field by removal of a limited number of fasteners thereby allowing replacement of the vent/glass, seals, or spring(s). The design facilitates better outboard drainage in the event that water was to enter between the upper and lower hinge members.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A hinge for a transom window, comprising:

an upper hinge member securable to a vent glass of the transom window;

a lower hinge member securable to a fixed glass of the transom window;

a hinge cover secured between the upper hinge member and the lower hinge member; and a spring element acting between the upper hinge member and the lower hinge member, wherein the upper hinge member includes a first pivot member cooperable with a corresponding second pivot member of the lower hinge member, and wherein each of the upper hinge member and the lower hinge member includes a stop surface that limits a pivot range of the upper hinge member relative to the lower hinge member, wherein the upper hinge member further includes a first spring seat on a side of the upper hinge member opposite from the pivot member, and one of the hinge cover and the lower hinge member includes a second spring seat, the spring element being secured between the first spring seat and the second spring seat, wherein the lower hinge member comprises a cover seat shaped substantially corresponding to an outside perimeter of the hinge cover, wherein the hinge cover is positioned in the cover seat, and wherein the upper hinge member is pivotable relative to the lower hinge member between a closed position and an open position, and wherein in the closed position, the spring element is positioned to bias the upper hinge member toward the closed position, and in the open position, the spring member is displaced over center to bias the upper hinge member toward the open position.

2. A hinge according to claim 1, wherein the first pivot member comprises a rail, and wherein the second pivot member comprises a follower.

3. A hinge according to claim 1, wherein the hinge cover comprises a stop arm extending from a position adjacent the lower hinge member toward the upper hinge member, a distal end of the stop arm being disposed in a pivot path of the upper hinge member.

4. A hinge according to claim 1, wherein each of the upper hinge member and the lower hinge member comprises at least one adhesive cavity.

5. A hinge according to claim 1, wherein the lower hinge member comprises a hinge cover channel, and wherein a portion of the hinge cover is engaged with the hinge cover channel.

6. A hinge according to claim 5, further comprising a fastener securing the portion of the hinge cover engaged with the hinge channel in the hinge channel.

7. A hinge according to claim 1, wherein the hinge cover extends over at least a portion of an outermost surface of the lower hinge member.

8. A transom window comprising:

a transom window frame;

a vent glass pivotable between a closed position and an open position;

a fixed glass secured to the transom window frame; and a hinge disposed between the vent glass and the fixed glass, the hinge comprising:

an upper hinge member affixed to the vent glass of the transom window, a lower hinge member affixed to the fixed glass of the transom window and fixed to the transom window frame, a hinge cover secured between the upper hinge member and the lower hinge member and engaging the lower hinge member, and a spring element positioned between the upper hinge member and the hinge cover and acting between the upper hinge member and the lower hinge member, wherein the upper hinge member includes a first pivot member cooperable with a corresponding second pivot member of the lower hinge member, and wherein each of the upper hinge member and the lower hinge member includes a stop surface that limits a pivot range of the upper hinge member relative to the lower hinge member, wherein the upper hinge member further includes a first spring seat on a side of the upper hinge member opposite from the pivot member, and the hinge cover includes a second spring seat, the spring element being secured between the first spring seat and the second spring seat, and the hinge cover being secured in position by the spring element urging the hinge cover into engagement with the lower hinge member, and wherein the upper hinge member is pivotable relative to the lower hinge member between a closed position and an open position, and wherein in the closed position, the spring element is positioned to bias the upper hinge member toward the closed position, and in the open position, the spring member is displaced over center to bias the upper hinge member toward the open position.

9. A transom window according to claim 8, wherein the first pivot member comprises a rail, and wherein the second pivot member comprises a follower.

10. A transom window according to claim 8, wherein the hinge cover comprises a stop arm extending from a position adjacent the lower hinge member toward the upper hinge member, a distal end of the stop arm being disposed in a pivot path of the upper hinge member.

11. A transom window according to claim 8, wherein each of the upper hinge member and the lower hinge member comprises at least one adhesive cavity, and wherein the upper hinge member is secured to the vent glass by an adhesive and the lower hinge member is secured to the fixed glass by an adhesive.

12. A transom window according to claim 8, wherein the lower hinge member comprises a cover seat shaped substantially corresponding to an outside perimeter of the hinge cover, wherein the hinge cover is positioned in the cover seat.

13. A multi-piece hinge pivotably connecting a top member and a bottom member, the hinge comprising:

an upper hinge member securable to the top member;

a lower hinge member securable to the bottom member and fixable in a frame;

a hinge cover secured between the upper hinge member and the lower hinge member; and a spring element acting between the upper hinge member and the lower hinge member via the hinge cover such that the hinge cover is positioned between the spring element and the lower hinge member, wherein the upper hinge member is pivotable relative to the lower hinge member across a pivot range between a closed position and an open position, the pivot range being limited by a stop assembly, and wherein in the closed position, the spring element is positioned to bias the upper hinge member toward the closed position, and in the open position, the spring member is displaced over center to bias the upper hinge member toward the open position.

14. A multi-piece hinge according to claim 13, wherein the hinge cover comprises a stop arm extending from a position adjacent the lower hinge member toward the upper hinge member, the stop assembly comprising a distal end of the stop arm disposed in a pivot path of the upper hinge member.

15. A multi-piece hinge according to claim 13, wherein the stop assembly further comprises at least a portion of the upper hinge member.

16. A multi-piece hinge according to claim 13, wherein the upper hinge member further includes a first spring seat on a side of the upper hinge member opposite from the pivot member, and the hinge cover includes a second spring seat, the spring element being secured between the first spring seat and the second spring seat.

17. A multi-piece hinge according to claim 13, wherein the upper hinge member includes a first pivot member cooperable with a corresponding second pivot member of the lower hinge member, and wherein the first pivot member comprises a rail, and wherein the second pivot member comprises a follower.

18. A multi-piece hinge according to claim 13, wherein the lower hinge member comprises a cover seat shaped substantially corresponding to an outside perimeter of the hinge cover, wherein the hinge cover is positioned in the cover seat.

19. A multi-piece hinge according to claim 13, wherein the hinge cover is secured in position without a fastener extending into or through the hinge cover.

* * * * *